US005944381A

United States Patent [19]

Nguyen

[11] Patent Number: 5,944,381

[45] Date of Patent: Aug. 31, 1999

[54] HANGING CHAIR

[76] Inventor: Xuan C. Nguyen, 1607 Springcreek Pkwy., Plano, Tex. 75023

[21] Appl. No.: 09/152,567

[22] Filed: Sep. 14, 1998

[51] Int. Cl.[6] ..... A47D 13/10

[52] U.S. Cl. ..... 297/281; 297/452.13; 5/122

[58] Field of Search ..... 472/118; 297/273, 297/274, 277, 279, 280, 452.12, 452.13, 452.11; 5/120, 122, 123, 127, 129, 130

[56] References Cited

U.S. PATENT DOCUMENTS 370,222 9/1887 Travers .
4,101,165 7/1978 Hammer .
4,221,429 9/1980 Wade .
4,825,855 5/1989 Kundson, Jr. .
4,838,609 6/1989 Christensen .
5,851,053 12/1998 Crawford .

*Primary Examiner*—Milton Nelson, Jr.
*Attorney, Agent, or Firm*—Robert H. Frantz

[57] ABSTRACT

A hanging chair is disclosed which includes use of a mesh fabric for a seat and back support portion. Also included in the hanging chair's design is a single fabric panel for a seat and back portion.

4 Claims, 6 Drawing Sheets

HANGING CHAIR

TECHNICAL FIELD OF THE INVENTION

This invention relates to furniture for indoor and outdoor use. More particularly, this invention relates to an improved hanging chair, which can be suspended from a tree bough or hook screwed into an overhead joist, and which is fabricated of a mesh material to provide improved outdoor durability and greater comfort.

BACKGROUND OF THE INVENTION

This invention relates to chairs specifically adapted for indoor and outdoor leisure use, and especially to hammock chairs and hanging chairs. Prior art hangjng chairs and hammock chairs have been constructed of solid fabric such as cotton canvas, or a netting material, such as fisherman's net.

Prior art hanging chairs constructed of solid fabric such as canvas can be uncomfortable to occupy for long lengths of time, especially in warm or humid weather. Solid fabrics do not allow air circulation from the occupant's skin. Thus, solid canvas hanging chairs can cause undesirable sweating during periods of long occupation. Additionally, solid canvas chairs can collect dirt, leaves, and moisture, leading to molding, mildew, and fabric rot.

Prior art hanging chairs constructed of fisherman's net do not share the disadvantages of solid material hanging chairs because they allow air, moisture, and some debris to fall through the chair. However, occupying a fisherman net hanging chair for any length of time can also be uncomfortable due to pressure points on the occupant's exposed skin created by the uneven distribution of weight along the strands of the net.

Therefore, there exists a need in the art for a hanging chair which allows air circulation around the occupant, allows moisture and debris to fall through, has acceptable weight distribution characteristics to prevent pressure points from forming on the occupant's skin, and which utilizes durable, low cost materials suitable for indoor and outdoor use.

SUMMARY OF THE INVENTION

The object of the present invention is to provide a hanging chair which is constructed of durable materials suitable for indoor and outdoor use, fabricated of a material which allows air circulation around the occupant and allows moisture and debris to fall through, has acceptable weight distribution characteristics, and is constructed of low cost materials.

The chair disclosed uses an inventive porthole-style mesh fabric in place of canvas or fisherman's netting, and is constructed of one or two panels to achieve the objects of the invention.

BRIEF DESCRIPTION OF THE DRAWINGS

For a more complete understanding of the invention.

FIG. 2 further exhibits the nature of the preferred embodiment design which avoids rigid frame member contact with the occupant.

DETAILED DESCRIPTION OF THE INVENTION

In accordance with the objects of the invention set forth in the Summary of the Invention, the hanging chair provides a frame to hold the chair in a open form without frame members contacting the occupant, provides a means for adjusting the angle of recline of the chair, utilizes a porthole-style mesh fabric, and minimizes the materials and labor costs associated with the chair.

Figure 1:
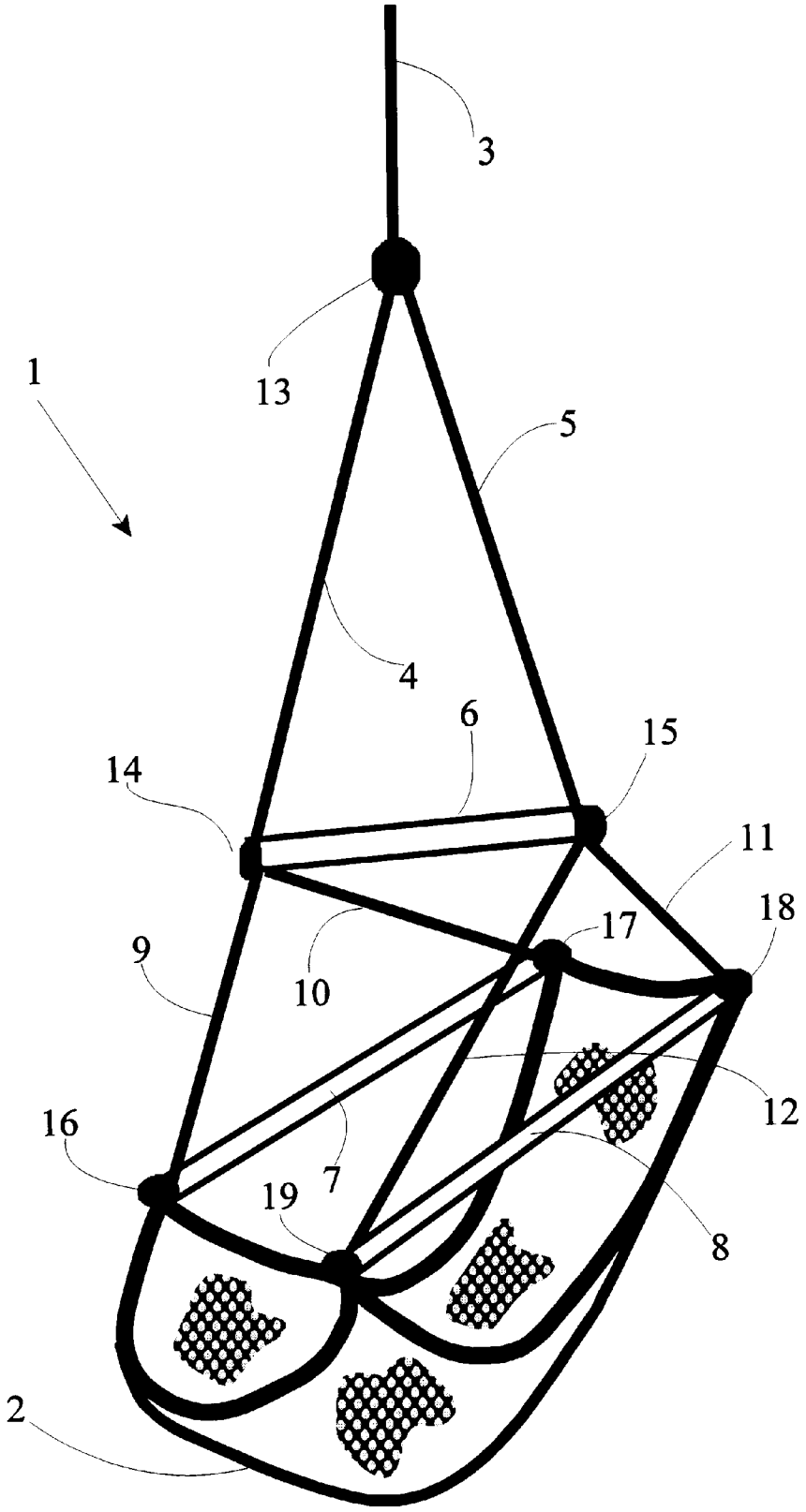
FIG. 1 shows a view of the unoccupied hanging chair in the preferred embodiment.
Figure 6:
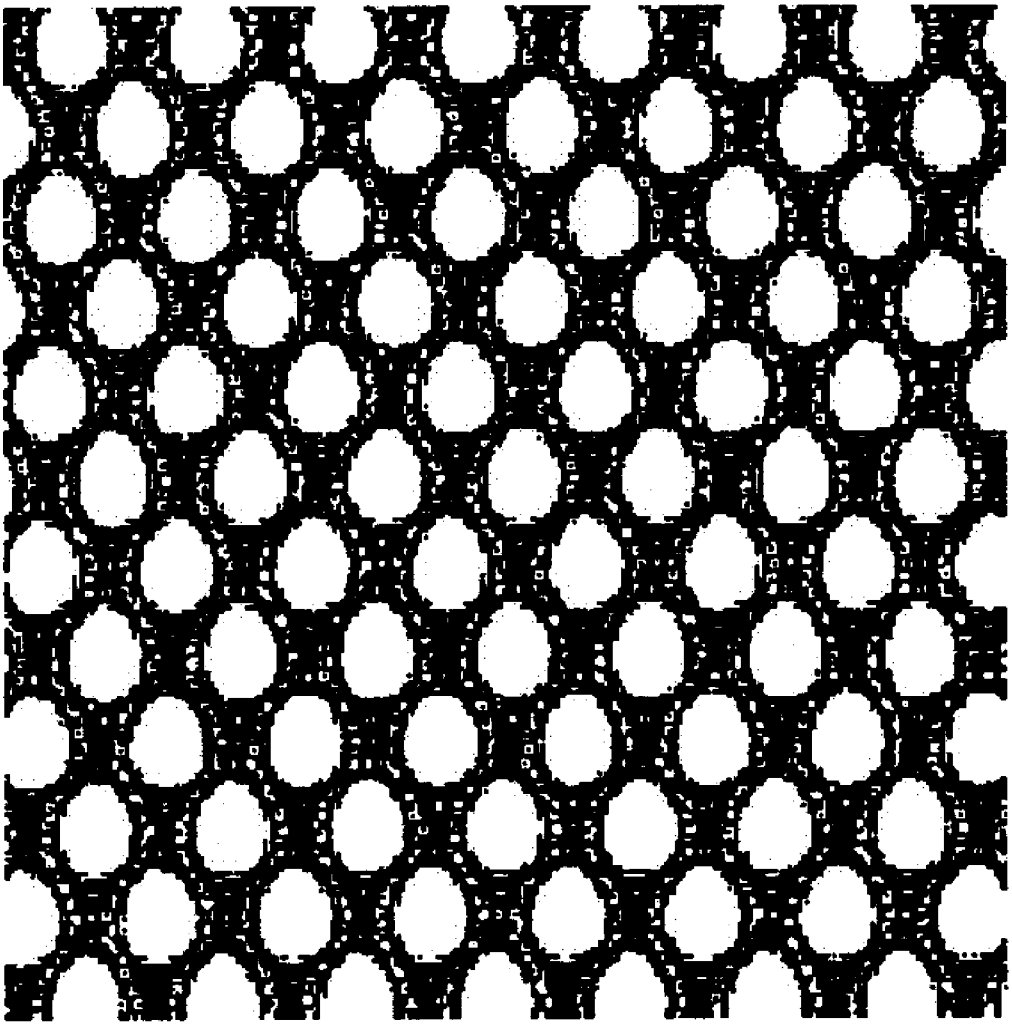
FIG. 6 shows a typical porthole style mesh fabric.

Turning to FIG. 1, the overall assembly of the chair is disclosed. The hanging chair (1) provides a chair portion (2) in which an occupant can sit or rest. Prior art hammocks have employed solid fabrics such as canvas, which does not breath well and may cause discomfort during hot weather. Further, solid fabric hammocks may pool moisture from dew or rain, leading to mildew and rot of the chair. To address these problems, other prior art hammocks have used a fisherman style of netting, but this netting produces a patterned pressure on the occupant's exposed skin creating discomfort. The chair portion (2) in the preferred embodiment is constructed of a porthole type polyester mesh, such as Apex Mills Corporation TK6 or TF72. This mesh of the preferred embodiment has an approximate weight of 9.5 to 11.5 ounces per square yard. The porthole mesh disclosed provides a flat surface on which the occupant's weight and stress is distributed evenly while maintaining a breathable surface, as shown in FIG. 6.

The chair portion (2) is held in the open position in the side-to-side direction by a single overhead transverse rigid member (6). The chair portion is further held open in the front-to-back direction by two rigid side members (7, 8) situated on either side of the chair portion as shown. None of the rigid members contact or bear weight of the occupant. In the preferred embodiment, the rigid members are fabricated of round, oak rods with suitable finish for outdoor use. However, other suitable materials such as metal and plastic may be used. The overhead transverse rigid member (6) is approximately 43 inches in length, and each of the side rigid members (7, 8) is approximately 32 inches in length for a chair sized for a typical adult occupant. The lengths of the rigid members may be scaled to produce smaller or larger hanging chairs for children and large adults.

FIG. 1 also shows the suspension harness, which is connected to an overhead support by a top tether rope (3). A bend (13) at the lower end of the top tether rope (3) connects two upper support ropes (4, 5) forming an inverted Y-shaped yoke with the top tether transverse to the seat portion (2). At the lower end of each of the upper support ropes (4, 5) is located a left and a right combination hitch and bend (14, 15), from which descend a left pair (9, 10) and a right pair (11, 12) pair of lower support ropes, which similarly form an inverted-Y shaped yoke with the upper support ropes (4, 5) respectively. The left pair and right pair of lower support ropes are attached to the combination hitch and bends using a half-knot, which allows for each adjustment of the lengths of the lower support ropes affecting the angle of recline of the chair portion (2). The left combination hitch and bend (14) and right combination hitch and bend (15) receive the ends of the overhead transverse rigid member (6), thereby providing the means to hold the chair portion (2) in the side-to-side open position.

Four lower hitches (16, 17, 18, 19) are located at the lower terminating ends of the lower support ropes, and provide a means for attaching the lower support ropes to the four corners of the chair portion (2). The four lower hitches also receive the ends of the left rigid member (7) and right member (8) as shown to provide a means to hold the chair portion (2) in a front-to-back open form when not occupied.

Figure 2:
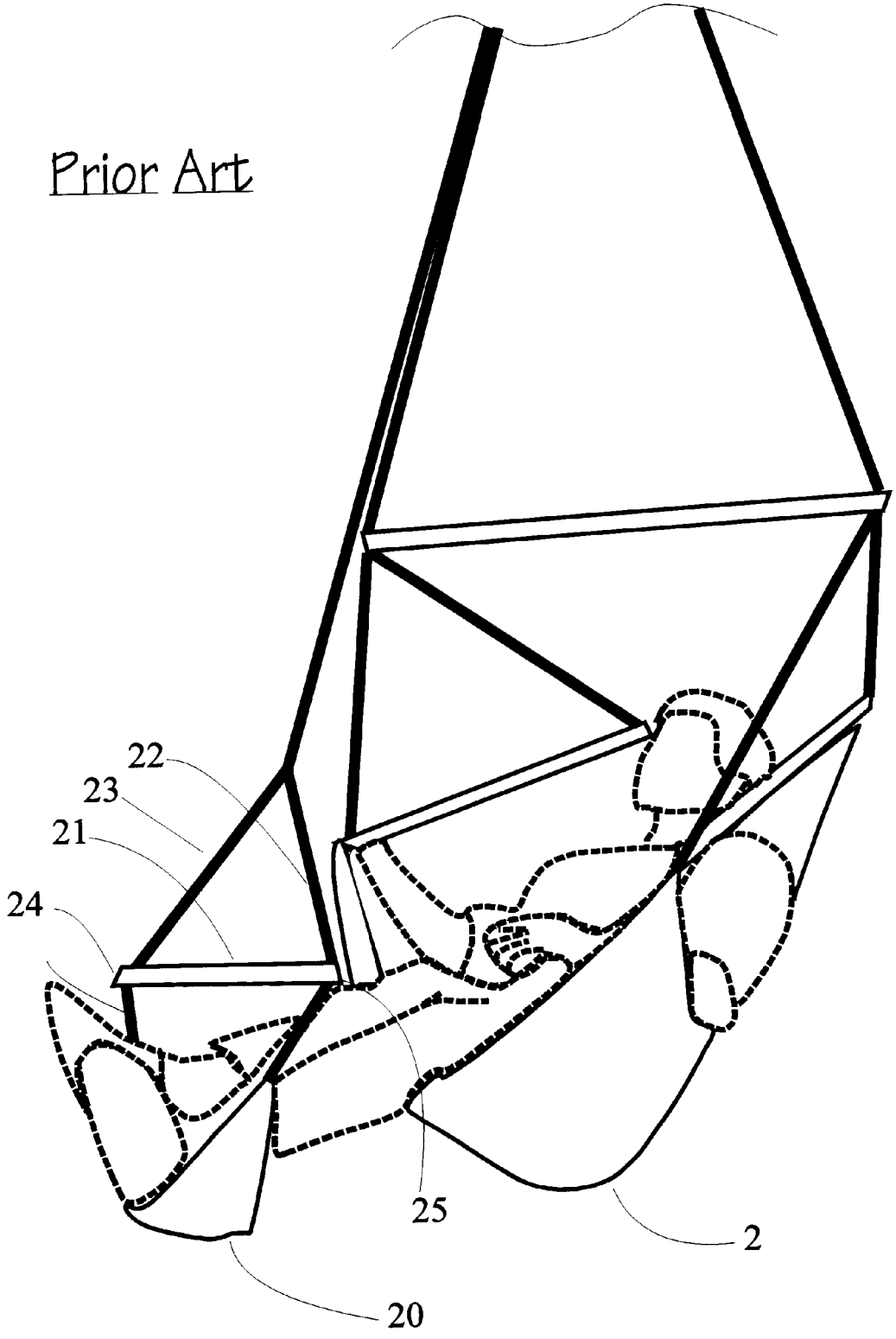
FIG. 2 depicts the chair and leg support when occupied, with the occupant illustrated in broken lines.

FIG. 2 further discloses the design of a foot and leg support which is constructed similarly, using an upper support rope forming an inverted-Y yoke (22,23), spread by a horizontal transverse rigid frame member (21) attached by combination hitch and bends (24, 25) to the yoke, and descending from which is a single sling-like foot and leg cradle (20). The cradle (20) in the inventive design is constructed of a porthole type mesh, such as Apex Mill TK6 or TF72.

Figure 3:
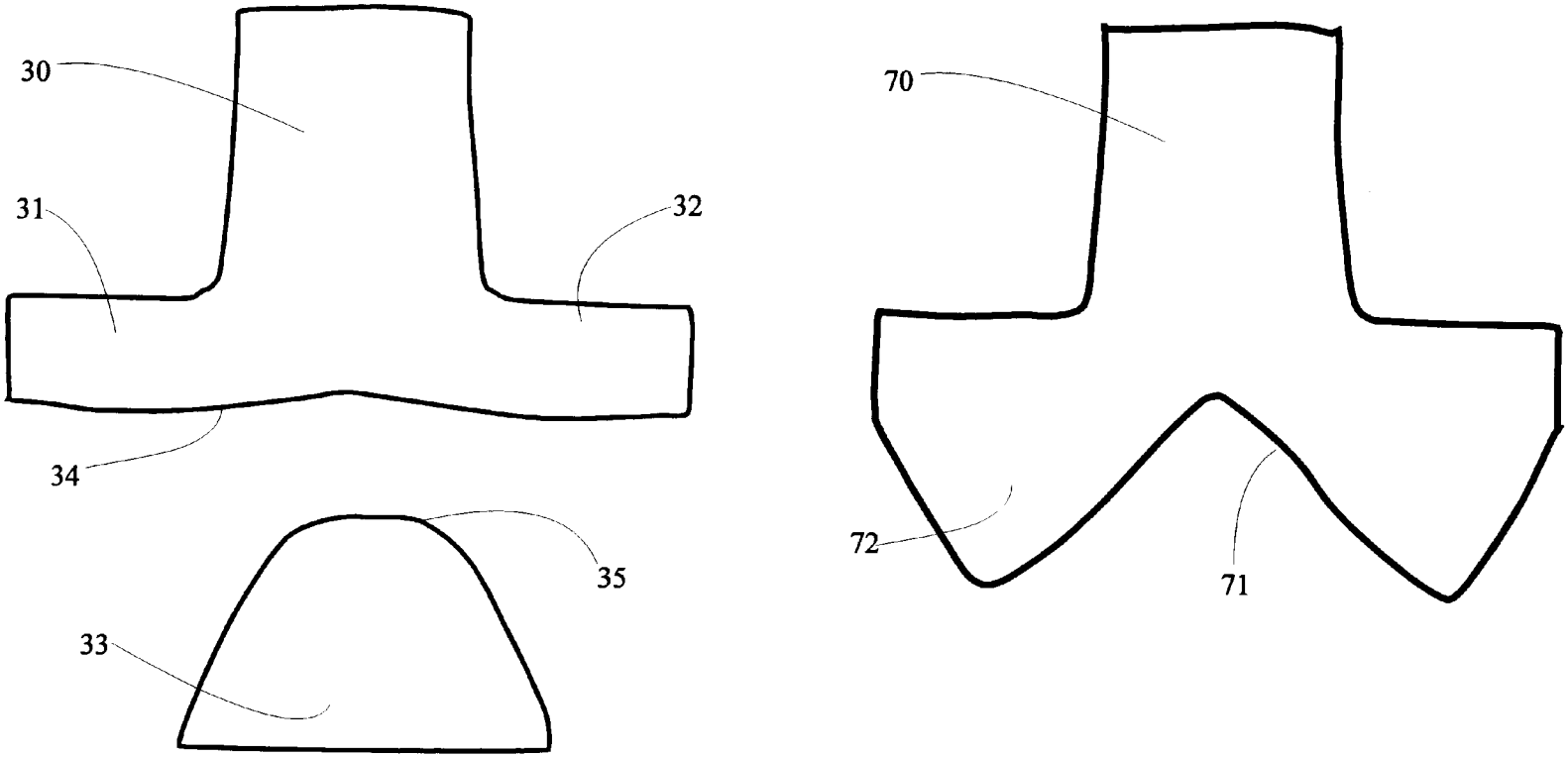
FIG. 3 shows the fabric panels necessary to form the seat and back portions of the chair. In one of the disclosed embodiments a two panel set is used, and in an alternate embodiment, a single panel is used.

FIG. 3 shows the two panels, a back portion panel (30) and a seat portion panel (33), which are combined to produce the chair portion (2) of FIG. 1. The back portion panel (30) is in the shape of an inverted-T, with the portion to engage the occupant's back being sufficiently tall enough to provide support to the entire back of the occupant, not just the small of the back. The side flaps of the back portion panel (31, 32) are bordered on the bottom by a slightly undulated edge (34). The seat portion panel (33) has a top edge (35) shaped in an inverted-U, of equal length as the back portion panel's lower undulated edge (34). The seat portion panel (33) has a straight or slightly curved lower edge. Alternately, a single panel (70) with a W-shaped edge (71) along the bottom of the panel, creates two halves of the seat portion (72). This embodiment allows the full chair portion to be constructed from one panel with one seam. Panels (30, 33, 70) are cut from porthole mesh in the preferred embodiment.

Figure 4B:
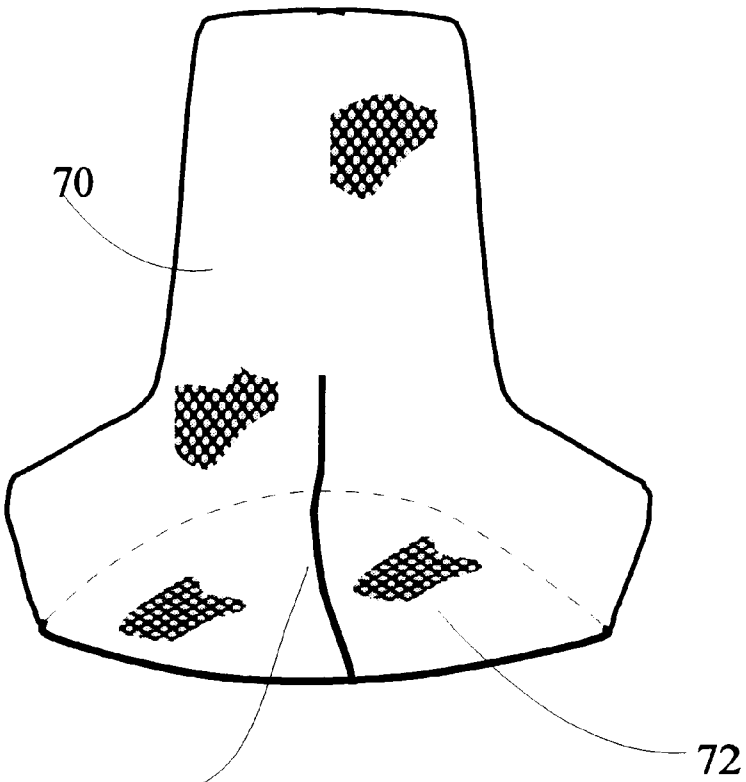
FIG. 4*b* shows the assembled chair portion using the single-panel design shown in FIG. 3.
Figure 4A:
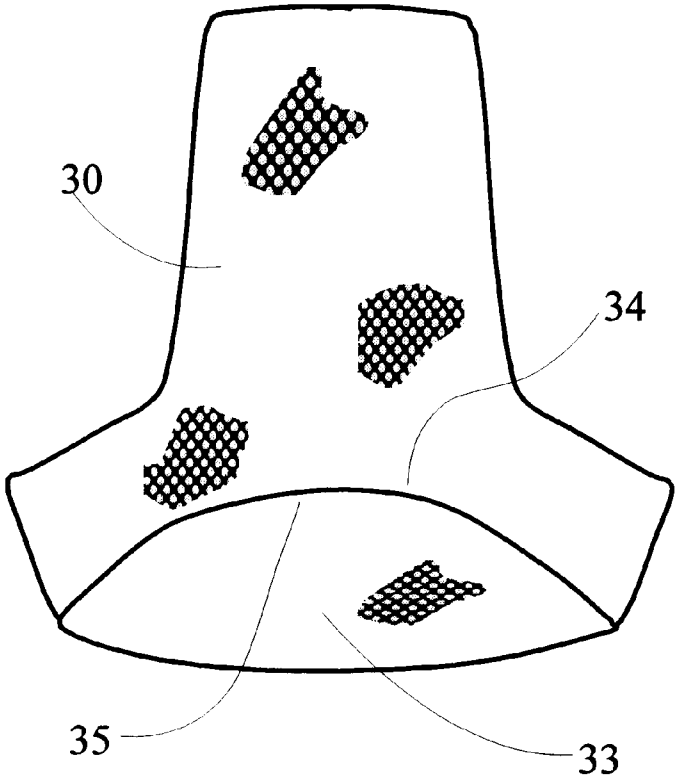
FIG. 4*a* discloses the assembled chair portion using the 2 panel design shown in FIG. 3.

FIG. 4*a* depicts the assembled chair portion when the back panel's lower edge (34) is mated to the seat panel's top edge (35) and affixed using sewing. Techniques for sewing two mesh or fabric panels together are well known in the art. The mating of the undulated edge (35) to the curved edge (35) shapes the back panel to an upright position, curved to comfortably engage the back of the occupant. In the alternate embodiment, the center of the W-shaped bottom edge (71) is sewn together as shown in FIG. 4*b* to create the seat portion with a single manufacturing action.

Figure 5:
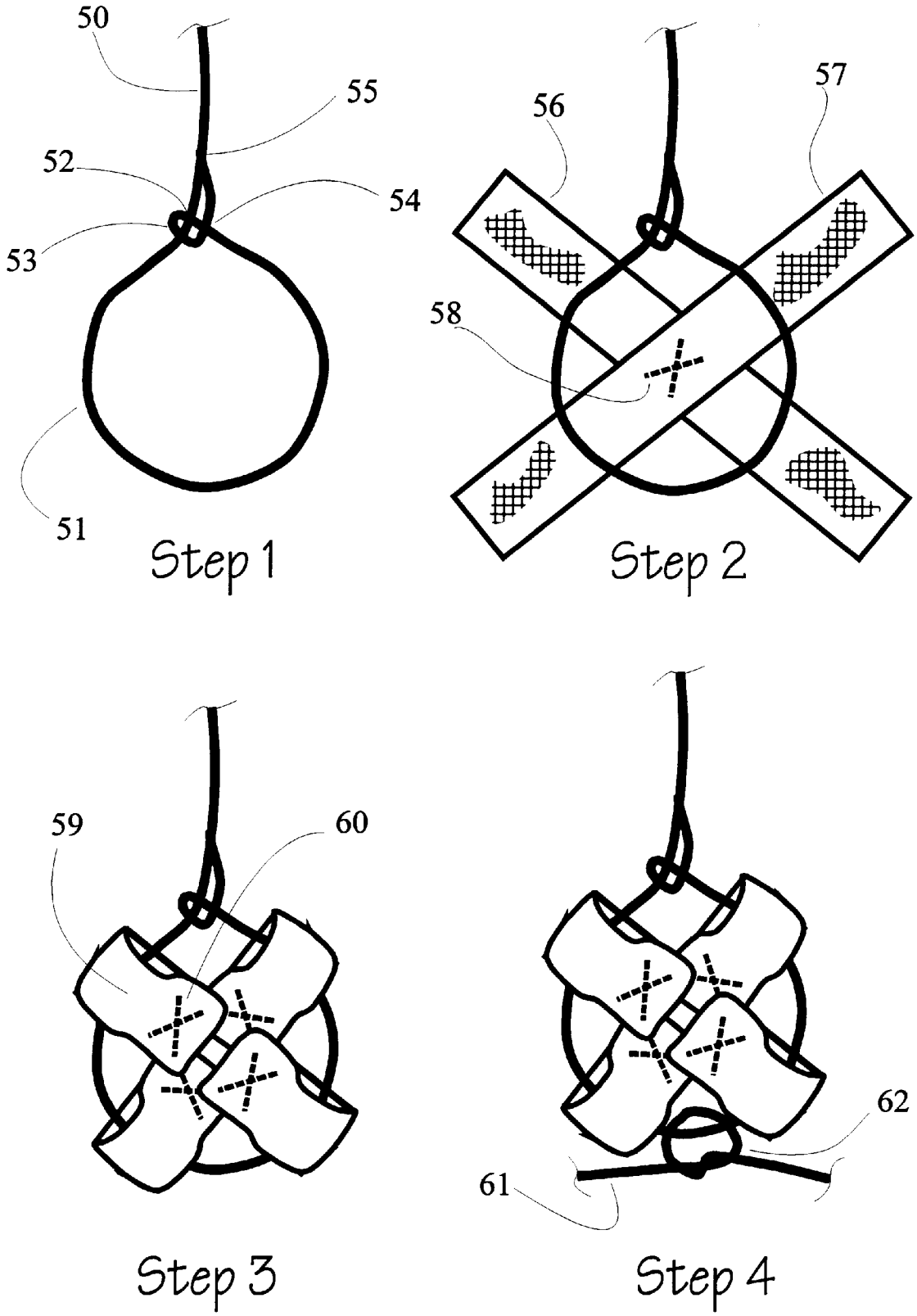
FIG. 5 teaches the steps to assemble the low cost eye splice, bend, and hitches used throughout the chair assembly, in a unified form.

In FIG. 5, the four steps to create the hitches and combination hitch bend used throughout the assembly are shown. Using a hollow braided rope, an eye splice is created in the first step. In the preferred embodiment, the eye splice is formed by taking the working end of the rope, forming a loop (51), and using a splicing fid, piercing the working end through the standing end of the rope (50) at the top of the loop (52), then returning the working end of the rope around (53) to pierce the portion of rope adjacent to the previous pierce (54), and finally splicing the working end into the standing end (55) of the rope. When the loop is placed under pressure, the core of the braided rope on the standing end reduces and provides retention of the spliced working end in a "Chinese handcuff" manner. Eye splices using hollow braided rope are well known in the rigging art, but are a novel component to hammock design allow reduction of materials and manufacturing cost. Prior art hammocks have used metal rings and/or full knots for this function in the past. The eye splice is quicker to produce, and does not share the weight and durability problems of metal rings.

The second step to form a hitch in FIG. 5 is to form a cross with two strips of nylon strapping (56, 57), stitched together to retain the cross shaped (58), and placed underneath the eye splice of the first step. Next, the four ends of the cross are folded inwards towards the center of the eye, as shown on (59), and stitched (60) to create captive loops around the eye (51) in four places. This forms a small basket for receiving the end of a rigid frame member as discussed supra.

In the fourth step of FIG. 5, a bend is formed by tying a second length of braided rope (61) to the bottom exposed portion of the eye (51) using a half-knot (62). The two ends of the rope (61) then form the lower two sections of the inverted-Y yokes discussed supra. Further, the use of the half-knot (62) allows the quick and easy adjustment of the lengths of rope on either side of the half-knot, allowing for angle of recline adjusment on the two bends of the lower support yoke, discussed supra. The use of a half-knot at this point of the assembly supports the objects of the invention to allow quick assembly and reduce part cost and count.

The preceding disclosure has set forth particular details of the construction of the inventive hanging chair. However, it will be understood by those skilled in the art that various changes in the form and details may be adopted without departing from the spirit and scope of the invention.

What is claimed is:

1. A hanging chair for supporting a seated person comprising:

a chair portion having a seat section and a back section, said back section having a lower edge and an upper edge with a right-upper corner and a left-upper corner, said seat section having a rear edge and a front edge with a right-front corner and a left-front corner, said back section forming an obtuse angle with said seat section connected along said seat section rear edge and said back section lower edge;

a first hitch for attaching a rope, said first hitch sewn to said back section left-upper corner;

a second hitch for attaching a rope, said second hitch sewn to said back section right-upper corner;

a third hitch for attaching a rope, said third hitch sewn to said seat section left-front corner;

a fourth hitch for attaching a rope, said fourth hitch sewn to said seat section right-front corner;

a first, second, third and fourth rope, each rope having an upper and a lower end, and each rope being attached at its lower end to said first, second, third and fourth hitches, respectively; and a means for attaching said upper ends of said first, second, third and fourth ropes to an overhead support, thereby hanging the chair portion from the overhead support.

2. A hanging chair for supporting a seated person as set forth in claim 1, wherein said chair portion is formed of mesh fabric.

3. A hanging chair for supporting a seated person as set forth in claim 2 wherein said mesh fabric is a porthole mesh fabric.

4. A hanging chair for supporting a seated person as set forth in claim 1 wherein said chair portion further comprises a single panel of fabric having an inverted T-shaped top edge and a W-shaped bottom edge, said W-shaped bottom edge having two sewn-together center segments and two outer segments, said seat section further comprised of the sewn-together two center segments of the W-shaped bottom edge, thereby causing the panel to form the back section at an obtuse angle to the seat section.

* * * * *